United States Patent [19]

Bunger

[11] Patent Number: 5,029,909

[45] Date of Patent: Jul. 9, 1991

[54] DOOR LOCK ASSEMBLY

[76] Inventor: Richard E. Bunger, 1834 W. 3rd St., Tempe, Ariz. 85281

[21] Appl. No.: 590,959

[22] Filed: Oct. 1, 1990

[51] Int. Cl.[5] ..... E05C 9/02

[52] U.S. Cl. ..... 292/40; 70/48

[58] Field of Search ..... 70/48; 292/36, 40, 143, 292/139, 148

[56] References Cited

U.S. PATENT DOCUMENTS

| | | | |
|---|---|---|---|
| 988,127 | 3/1911 | Moe | 70/48 |
| 1,842,286 | 1/1932 | Potter | 292/148 X |
| 2,169,692 | 8/1939 | Hansen | 292/40 X |
| 2,556,361 | 6/1951 | Coleman | 292/148 X |
| 3,181,903 | 5/1965 | Olander | 292/36 X |
| 3,334,933 | 8/1967 | Ehlere | 292/148 |
| 3,606,423 | 9/1971 | McCarthy | 70/55 X |
| 3,652,114 | 3/1972 | Cady et al. | 292/281 |
| 3,727,438 | 4/1973 | Knaack | 70/63 |
| 3,736,016 | 5/1973 | Garvey et al. | 292/281 |
| 3,744,280 | 7/1973 | Brown, Jr. et al. | 70/54 |
| 3,884,057 | 5/1975 | Maurer | 70/259 |
| 3,961,816 | 6/1976 | Mueller | 292/148 |
| 4,102,161 | 7/1978 | Proefrock | 70/42 |
| 4,277,961 | 7/1981 | Williams | 70/54 |
| 4,307,904 | 12/1981 | Daus | 292/148 |
| 4,322,102 | 3/1982 | Lindblom | 291/281 |
| 4,506,528 | 3/1985 | Eberly | 70/18 |
| 4,581,907 | 4/1986 | Eberly | 70/54 |

*Primary Examiner*—Richard E. Moore

*Attorney, Agent, or Firm*—Warren F. B. Lindsley

[57] ABSTRACT

A protective device for locking two relatively movable objects of a cargo container in a fixed relationship employing a longitudinal bar mechanism pivotally mounted on one of said objects for cooperatively engaging with a pair of keepers mounted on the other of said objects for locking the objects together and a first rod assembly pivotally connected to one end of the bar mechanism and a handle at its other end with the rod moving longitudinally into engagement with one of the keepers. A housing is mounted around the rod assembly through which the rod is movable and defines a recess which exposes a predetermined portion of the length of the rod assembly. An aperture is formed in the predetermined portion of the rod assembly through which a shackle or padlock may be placed to lock the protective device.

5 Claims, 2 Drawing Sheets

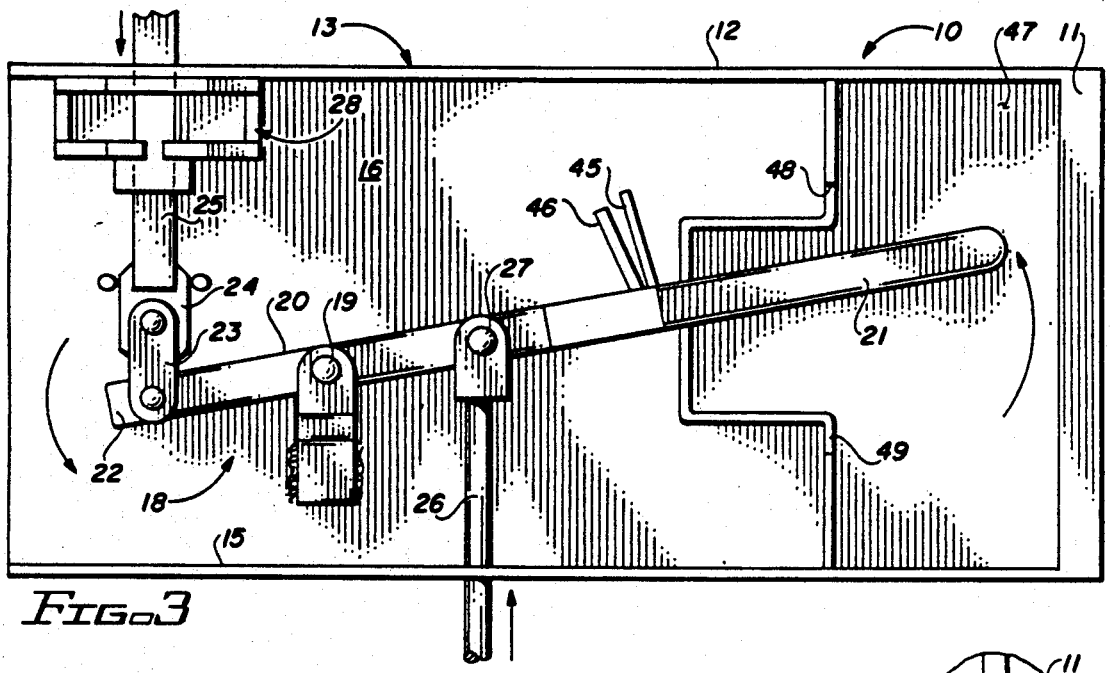
FIG. 3
FIG. 4
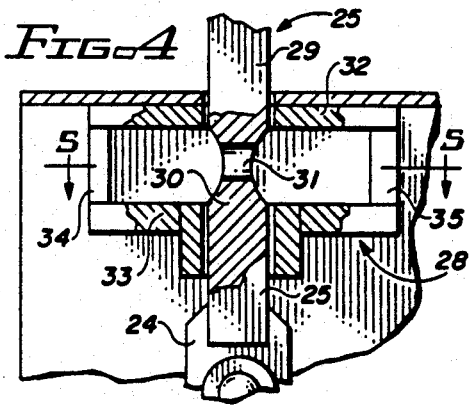
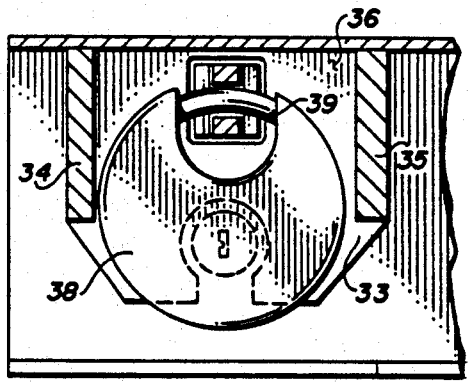
FIG. 5
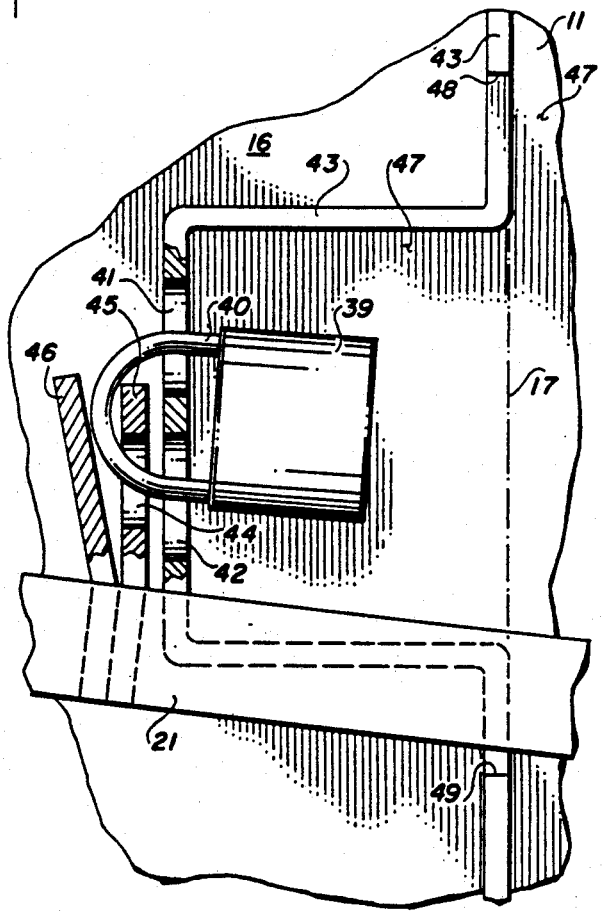
FIG. 6

DOOR LOCK ASSEMBLY

BACKGROUND OF THE INVENTION

This invention relates to door look assemblies and more particularly to a module comprising a housing which encloses a shiftable bar which housing is shaped to define a recess for receiving and covering the shackle of a padlock when the shackle interlocks with the shiftable bar.

The protective device is formed of steel to prevent access to the shackle of the padlock for severing purposes.

DESCRIPTION OF THE PRIOR ART

Although the prior art shows protective devices for padlocks, none are believed to illustrate the type of device disclosed and claimed for protecting the shackle of a padlock which is used to interlock relatively shiftable members of a modular locking system.

U.S. Pat. No. 3,744,280 discloses means for preventing the cutting or breaking of a padlock where access to the shackle is prevented by a guard, flange and case.

U.S. Pat. No. 4,102,161 discloses a padlock having a pivotable sliding shackle.

U.S. Pat. No. 4,581,907 discloses a padlock protector in which the padlock shackle is inaccessible to a bolt cutter or other cutting device by wall portions which restrict access to the shackle.

The following U.S. patents of interest are directed to security lock protecting apparatus, but are not believed to anticipate the claimed invention.

| | |
|---|---|
| 4,506,528 | 3,736,016 |
| 4,322,102 | 3,727,438 |
| 4,277,961 | 3,652,114 |
| 3,844,057 | |

SUMMARY OF THE INVENTION

In accordance with the invention claimed, an improved protective device for padlocks is provided which positions the circular shackle of a disk type padlock in an unaccessible position to a cutting or drilling tool.

It is, therefore, one object of this invention to provide a new and improved protective device for padlocks employing shift levers or members to secure a door assembly in place to prevent theft.

Another object of this invention is to provide a padlock protector which includes retainer members defining a recess to receive the shackle of a padlock in a position to prevent the use of a cutting or drilling tool to sever the shackle.

A further object of this invention is to provide a module for inserting in a cavity in a door which will comprise a shiftable bar and padlock locking mechanism designed to protect the locking mechanism from cutting and drilling tools.

Other objects and advantages of the invention will be set forth in the description which follows, and in part will be obvious from the description of the hardware disclosed.

BRIEF DESCRIPTION OF THE DRAWINGS

The present invention may be more readily described by reference to the accompanying drawings in which:

FIG. 3 is a view similar to that shown in FIG. 2 with the bar mechanism in unlocked position;

FIG. 4 is an enlarged view of the circled area marked 4 in FIG. 2;

FIG. 5 is a cross sectional view of FIG. 4 taken along the line 5—5; and FIG. 6 is an enlarged view of a second locking mechanism shown in FIG. 1.

DESCRIPTION OF THE PREFERRED EMBODIMENT

Referring more particularly to the drawings by characters of reference, FIGS. 1–6 disclose a door, opening, closing and locking mechanism 10 for doors of a storage container or other door assembly 11. More particularly, this mechanism may comprise a sealed module for fitting into a cavity in the door assembly and can be separately manufactured as a module especially for this purpose.

Figure 1:
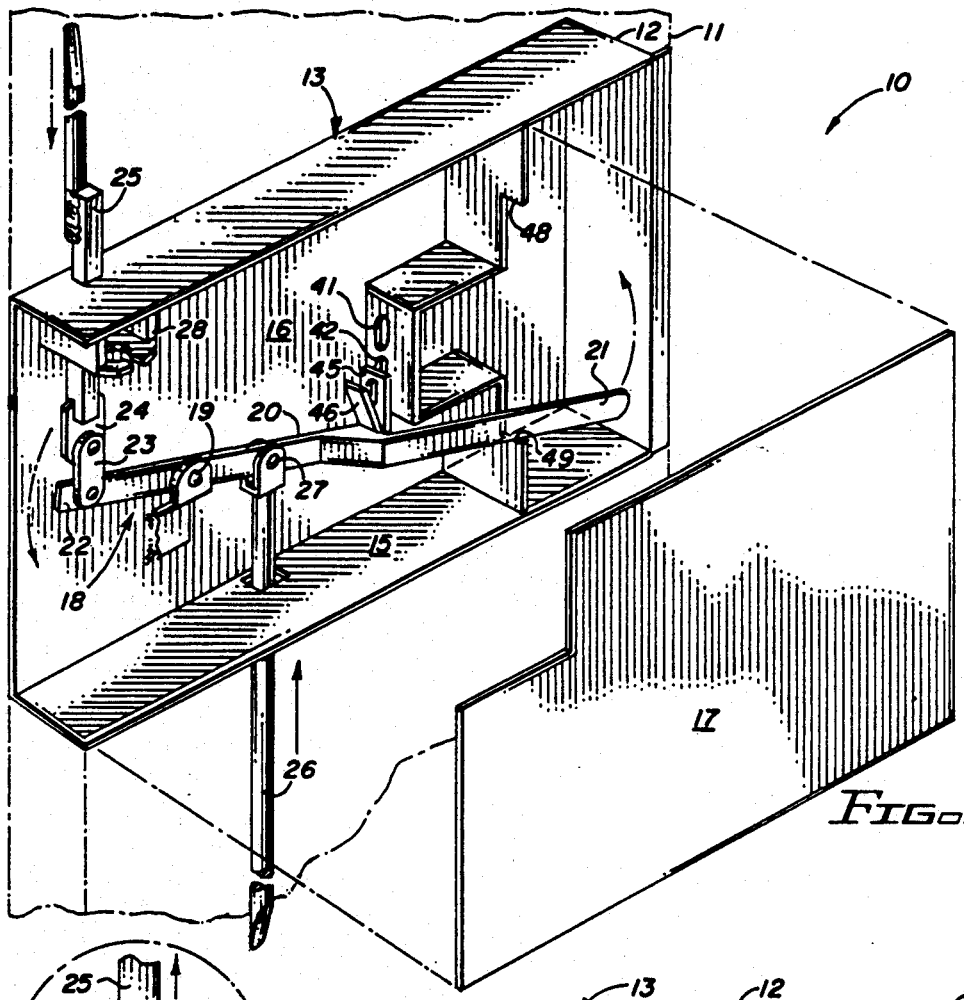
FIG. 1 is a perspective exploded view of a housing module for fitting into a cavity of a door comprising a shiftable bar mechanism and means for locking the mechanism with the shackle of a padlock.

This door assembly 11 comprises a housing 13 having top, bottom, back and front surfaces 14, 15, 16 and 17, respectively. A latching mechanism 18 is pivotally mounted at 19 to back 16 of the housing as shown in FIG. 1 and comprises a pivotally mounted rod 20 one end of which comprises a handle 21 and the other end 22 is connected to a link 23 which is connected through a connector 24 to an oilless pin or push rod assembly 25.

A second oilless pin or push rod assembly 26 is pivotally connected to rod 20 at a point 27 between its handle 21 and other end 22. Each of push rod assemblies 25 and 26 having camming surfaces at their ends move into and out of keepers or latches (not shown) on a marginal part of a storage container (not shown) on which one or more door assemblies are hingedly mounted under pressure to form a weather tight seal. Thus, rod 20 may be moved from door locked position shown in FIG. 1 to door closed position shown in FIG. 2.

Figure 2:
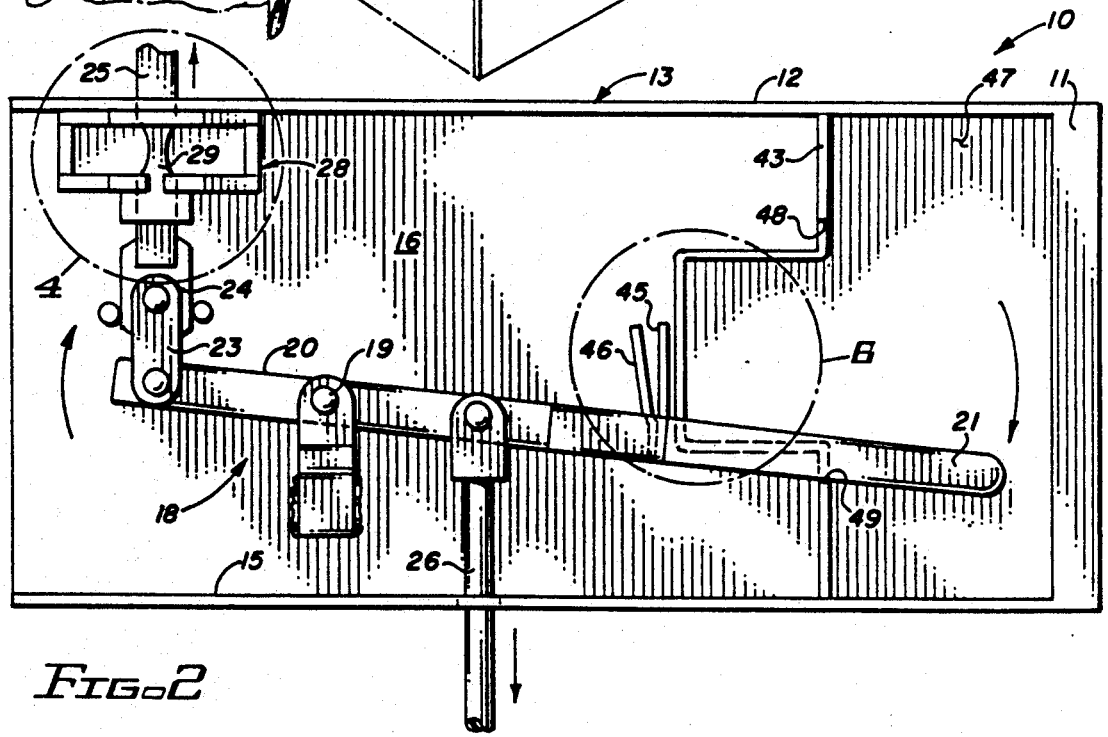
FIG. 2 is a front enlarged view of the shiftable bar mechanism shown in FIG. 1 in a locked position.

In door closed position the push rod assembly 25 is moved upwardly through a housing 28 to its door latching position to seal under pressure the door to associated storage container. As shown in FIGS. 2 and 4 this assembly comprises a rod 29 which is necked down at 30 and through which an aperture 31 is provided laterally thereof. When the push rod assembly 25 is in door latched position, the necked down portion of the rod assembly is in the center of housing 28. Housing 28 comprises a padlock retainer which comprises a pair of spaced parallelly positioned plates or flanges 32 and 33 which together with side plates 34 and 35 form an open cavity or recess 36 into which a shackle 37 of a padlock 38 may be inserted as shown in FIG. 5.

In order for shackle 37 of padlock 38 to interlock with push rod assembly 25, hole or aperture 31 was provided through rod 29 and is so positioned that shackle 37 can extend to and pass through it when push rod assembly 25 is in its upper latched position.

When the circular shackle is withdrawn from aperture 31 by actuation of a key of the padlock, the push rod assembly 25 may be actuated longitudinally by handle 21 of rod 20 to the position shown in FIG. 3 to unlock the door assembly.

It should be noted that when a locking procedure is undertaken, push rod assembly is moved to its position shown in FIG. 2 so that rod 29 and aperture 31 therethrough is moved within housing 28. Since the shear point of rod 29 is weakest at aperture 31, the shear point is concealed within housing 28 when the disk lock or padlock 38 is in place in housing 28.

It should be noted that when padlock 38 is in position in retainer or housing 28, its shackle 37 is within recess 36 of housing 28 out of reach and sight of a thief intending on cutting the shackle so that the padlock can be removed from the protective device. Even though the key tumbler is drilled out, the shackle of the lock can not be rotated.

To further aid in securing the storage container, a second padlock 39 is provided. The shackle 40 of this padlock is intended t fit through openings 41 and 42 formed in a wall 43 which defines an opening 47 in the door assembly 11 into which handle 21 extends. As shown in FIGS. 1, 2, 3 and 6, a pair of braces 45 and 46 are mounted on handle 21 to extend laterally therefrom and within a cavity formed within housing 13. Brace 45 is provided with an aperture 44 extending therethrough which aperture is aligned with opening 42 in wall 43 when handle 21 is in its locked position. Cavity 47 within which handle 21 extends is exposed when front 17 is secured to the top 14 and bottom 15 of housing 13. Brace 46 forms a lock stop for shackle 40 during a locking operation of the padlock. The spacing between braces 45 and 46 are such that the shackles of various size padlocks may be threaded between the braces and through apertures 41, 42 and 44.

It should be noted that a cut out of the upper left corner of front 17 of housing 13 exposes padlock 38 for locking and unlocking of the locking mechanism 10.

Further, wall 43 forms surfaces 48 and 49 which provide limits or stops for movement of handle 21 in the protective device's opening and closing operation. As noted from the drawings, handle 21 moves in an arcuate manner with suitable linkages connecting the handle to rods 25 and 26 to cause and maintain their movement in a vertical manner. As evident from FIG. 6 of the drawings, padlock 39 when installed in the door lock assembly lays on its side so that it would be difficult if not impossible to insert a pinch rod into the hollow of its shackle to break or destroy its locking mechanism.

Although but one embodiment of the present invention has been illustrated and described, it will be apparent to those skilled in the art that various changes and modifications may be made therein without departing from the spirit of the invention or from the scope of the appended claims.

What is claimed is:

1. A protective device for locking two relatively movable objects of a cargo container in a fixed relationship comprising:

a longitudinal bar mechanism pivotally mounted on one of said objects, a first rod assembly pivotally connected to one end of said bar mechanism for movement longitudinally thereof in a first direction for engaging one of a pair of keepers both mounted on the other of said objects and a second rod assembly pivotally connected to said bar mechanism at a point between its ends for movement longitudinally thereof in a direction opposite to the movement of said first rod assembly for engaging the other of said keepers, a housing mounted around said first rod assembly through which said first rod assembly is movable.

said housing comprising a recess which exposes a predetermined portion of the length of said first rod assembly when said first rod assembly is in cooperative engagement with one of said keepers and forms an opening for receiving the shackle of a padlock, a first aperture formed in said predetermined portion to extend through said first rod assembly for receiving the shackle of a first padlock when said first rod assembly engages said one of said keepers, a wall mounted on one of said objects through which the other end of said bar mechanism extends, said other end of said bar mechanism comprising a handle formed on one side of said wall, second and third apertures spacedly formed in said wall, a flange mounted to extend laterally of said bar mechanism on the other side of said wall juxtapositioned to said wall, and a fourth aperture formed in said flange, said third and fourth apertures being axially aligned when said handle is moved to protective device locking position and causing said first rod assembly and said second rod assembly into keeper engagement positions, whereby when said protective device is in keeper engaging positions the shackle of a second padlock may be extended through said second, third and fourth apertures to form a dual locking function.

2. The protective device set forth in claim 1 wherein:

said housing comprises two parallelly spaced members forming said recess therebetween, said spaced members enclose the shackle of said first padlock when it extends through said opening.

3. The protective device set forth in claim 1 wherein:

said wall comprises stops for limiting the movement of said handle in locked and unlocked engagement of said first and said second rod assembly with said first and said second keepers.

4. The protective device set forth in claim 2 wherein:

said members are spaced apart a distance slightly larger than the width of said first padlock.

5. The protective device set forth in claim 1 in further combination with:

a padlock, said padlock comprising a disk type lock having a circular reciprocating shackle and a key actuated tumbler for movement of said shackle, said shackle being concealed in said recess when said first rod assembly is in cooperative engagement with said one of said keepers and said shackle extends through said opening, whereby said key tumbler of the protective device may be tampered with without affecting movement of said shackle.

* * * * *